US008593067B2

(12) United States Patent
Iwai et al.

(10) Patent No.: US 8,593,067 B2
(45) Date of Patent: Nov. 26, 2013

(54) LED LIGHTING DEVICE AND ILLUMINATION APPARATUS

(75) Inventors: Naoko Iwai, Yokosuka (JP); Hajime Osaki, Yokosuka (JP); Kenichi Asami, Yokosuka (JP); Hitoshi Kawano, Yokosuka (JP); Masatoshi Kumagai, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 217 days.

(21) Appl. No.: 13/013,271

(22) Filed: Jan. 25, 2011

(65) Prior Publication Data

US 2011/0181198 A1 Jul. 28, 2011

(30) Foreign Application Priority Data

Jan. 27, 2010 (JP) ..... 2010-015158
Jan. 27, 2010 (JP) ..... 2010-015159

(51) Int. Cl.
*H05B 37/02* (2006.01)

(52) U.S. Cl.
USPC ..... 315/209 R; 315/299; 315/308

(58) Field of Classification Search
USPC ..... 315/209 R, 291, 299, 307, 308
See application file for complete search history.

(56) References Cited

U.S. PATENT DOCUMENTS 6,147,458 A 11/2000 Bucks
7,321,206 B2 * 1/2008 Kang et al. ..... 315/291
2003/0042437 A1 * 3/2003 Worley et al. ..... 250/551
2007/0159750 A1 7/2007 Peker
2007/0188112 A1 8/2007 Kang et al.
2008/0224627 A1 * 9/2008 Genest ..... 315/224
2008/0316781 A1 12/2008 Liu
2010/0001663 A1 1/2010 Wu
2010/0090618 A1 4/2010 Veltman
2010/0117656 A1 5/2010 Snelton
2011/0050129 A1 3/2011 Rudolph
2011/0085335 A1 4/2011 Osawa
2011/0089846 A1 4/2011 Ido
2011/0109230 A1 5/2011 Simi

FOREIGN PATENT DOCUMENTS

JP 10-46324 2/1998
JP 10-149888 6/1998
JP 11-087072 3/1999

(Continued)

OTHER PUBLICATIONS

English Language Abstract of JP 2010-110157 published May 13, 2010.

(Continued)

*Primary Examiner* — Thuy Vinh Tran
(74) *Attorney, Agent, or Firm* — DLA Piper LLP (US)

(57) ABSTRACT

According to one embodiment, an LED lighting device includes a DC source, a non-insulated step-down chopper and a light emitting diode. The non-insulated step-down chopper includes: a first circuit in which a switching element, a current detecting impedance element and an inductor are connected in series to each other; a second circuit in which the inductor and a freewheel diode are connected in series to each other; and a control portion for controlling the switching element. A power portion including the switching element and the control portion are constituted by a single package IC, and the current detecting impedance element and inductor are attached to the outside of the IC.

5 Claims, 3 Drawing Sheets

(56) References Cited

FOREIGN PATENT DOCUMENTS

| | | |
|---|---|---|
| JP | 2000-260578 | 9/2000 |
| JP | 2001-210478 | 8/2001 |
| JP | 2002-231471 | 8/2002 |
| JP | 2003-157986 | 5/2003 |
| JP | 2004-119078 | 4/2004 |
| JP | 2004-327152 | 11/2004 |
| JP | 2005-011739 | 1/2005 |
| JP | 2005-129512 | 5/2005 |
| JP | 2005-142137 | 6/2005 |
| JP | 2006-108117 | 4/2006 |
| JP | 2006-269349 | 10/2006 |
| JP | 2007-6658 | 1/2007 |
| JP | 2007-59635 | 3/2007 |
| JP | 2007-142057 | 6/2007 |
| JP | 2007-234415 | 9/2007 |
| JP | 2007-281424 | 10/2007 |
| JP | 2007-538378 | 12/2007 |
| JP | 2008-053695 | 3/2008 |
| JP | 2008-210537 | 9/2008 |
| JP | 2008-310963 | 12/2008 |
| JP | 2009-10100 | 1/2009 |
| JP | 2009-33098 | 2/2009 |
| JP | 2009-189170 | 8/2009 |
| JP | 2009-218528 | 9/2009 |
| JP | 2009-266599 | 11/2009 |
| JP | 2010-110157 | 5/2010 |
| TW | 200901829 | 1/2009 |
| TW | 2010 17042 | 5/2010 |
| WO | WO 00/02421 | 1/2000 |
| WO | WO 2005/115058 | 12/2005 |
| WO | WO 2008/132652 | 11/2008 |
| WO | WO 2008/132661 | 11/2008 |
| WO | WO 2009/001279 | 12/2008 |
| WO | WO 2009/055821 | 4/2009 |
| WO | WO 2009/089919 | 7/2009 |
| WO | WO 2010/005291 | 1/2010 |
| WO | WO 2010/007985 | 1/2010 |
| WO | WO 2010/050659 | 6/2010 |

OTHER PUBLICATIONS

English Language Translation of JP 2010-110157 published May 13, 2010.
Japanese Office Action issued on Nov. 21, 2011 in JP 2010-015159.
English Language Translation of Japanese Office Action issued on Nov. 21, 2011 in JP 2010-015159.
English Language Abstract of JP 2009-266599 published Nov. 12, 2009.
English Language Translation of JP 2009-266599 published Nov. 12, 2009.
English Language Abstract of JP 10-149888 published Jun. 6, 1998.
English Language Translation of JP 10-149888 published Jun. 6, 1998.
English Language Abstract of JP 2009-033098 published Feb. 12, 2009.
English Language Translation of JP 2009-033098 published Feb. 12, 2009.
English Language Abstract of WO 2009/089919 published Jul. 23, 2009.
English Language Abstract of JP 2009-189170 published Aug. 20, 2009.
English Language Translation of JP 2009-189170 published Aug. 20, 2009.
English Language Abstract of JP 10-046324 published Feb. 17, 1998.
English Language Translation of JP 10-046324 published Feb. 17, 1998.
English Language Abstract of JP 2007-059635 published Mar. 8, 2007.
English Language Translation of JP 2007-059635 published Mar. 8, 2007.
English Language Abstract of JP 2007-142057 published Jun. 7, 2007.
English Language Translation of JP 2007-142057 published Jun. 7, 2007.
European Search Report issued in EP 11166087 on Oct. 20, 2011.
European Search Report issued in EP 11177418 on Dec. 6, 2011.
English Language Abstract of TW 2010-17042 published on May 1, 2010.
Extended European Search Report issued in EP 11171024 on Dec. 1, 2011.
U.S. Appl. No. 13/218,767 as of Sep. 6, 2012.
English language abstract of JP 2008-210537, published Sep. 11, 2008.
Machine English language translation of JP 2008-210537, published Sep. 11, 2008.
English language abstract of JP-2008-053695 published Mar. 6, 2008.
Machine English language translation of JP-2008-053695 published Mar. 6, 2008.
English language abstract of JP-2007-538378 published Dec. 27, 2007.
Machine English language translation of JP-2007-538378 published Dec. 27, 2007.
English language abstract of JP 2005-11739 published Jan. 13, 2005.
Machine English language translation of JP 2005-11739 published Jan. 13, 2005.
English language abstract of JP 11-087072 published Mar. 30, 1999.
Machine English language translation of JP 11-087072 published Mar. 30, 1999.
English Language Abstract of JP 2009-218528 Published Sep. 24, 2009.
English Language Translation of JP 2009-218528 Published Sep. 24, 2009.
English Language Abstract of JP 2004-119078 Published Apr. 15, 2004.
English Language Translation of JP 2004-119078 Published Apr. 15, 2004.
English Language Abstract of JP 2007-6658 Published Jan. 11, 2007.
English Language Translation of JP 2007-6658 Published Jan. 11, 2007.
English Language Abstract of JP 2003-157986 Published May 30, 2003.
English Language Translation of JP 2003-157986 Published May 30, 2003.
English Language Abstract of JP 2008-310963 Published Dec. 25, 2008.
English Language Translation of JP 2008-310963 Published Dec. 25, 2008.
International Search Report issued in PCT/JP2009/055871 on Jun. 9, 2009.
English Language Abstract of JP 2002-231471 Published Aug. 15, 2002.
English Language Translation of JP 2002-231471 Published Aug. 15, 2002.
English Language Abstract of JP 2004-327152 Published Nov. 18, 2004.
English Language Translation of JP 2004-327152 Published Nov. 18, 2004.
English Language Abstract of JP 2005-129512 Published May 19, 2005.
English Language Translation of JP 2005-129512 Published May 19, 2005.
English Language Abstract of JP 2007-234415 Published Sep. 13, 2007.
English Language Translation of JP 2007-234415 Published Sep. 13, 2007.
English Language Abstract of JP 2001-210478 Published Aug. 3, 2001.
English Language Translation of JP 2001-210478 Published Aug. 3, 2001.
English Language Abstract of JP 2006-269349 Published Oct. 5, 2006.
English Language Translation of JP 2006-269349 Published Oct. 5, 2006.

(56) References Cited

OTHER PUBLICATIONS

International Search Report issued in PCT/JP2009/055873 on Jun. 9, 2009.
Japanese Office Action issued in JP 2008-076837 on Jul. 6, 2010.
English Translation of Japanese Office Action issued in JP 2008-076837 on Jul. 6, 2010.
English Language Abstract of JP 2006-108117 published Apr. 2006.
Machine Translation of JP 2006-108117 published Apr. 20, 2006.
English Language Abstract of JP 2008-281424 published Nov. 20, 2008.
Machine Translation of JP 2008-281424 published Nov. 20, 2008.
Japanese Office Action issued in JP 2008-076835 on Aug. 24, 2010.
English Translation of Japanese Office Action issued in JP 2008-076835 on Aug. 24, 2010.
English Language Abstract of JP 2005-142137 published Jun. 2, 2005.
English Language Translation of JP 2005-142137 published Jun. 2, 2005.
U.S. Appl. No. 12/942,055 as of Jul. 25, 2011.
U.S. Appl. No. 13/106,487 as of Jul. 25, 2011.
U.S. Appl. No. 13/162,678 as of Jul. 25, 2011.
U.S. Appl. No. 13/169,748 as of Jul. 25, 2011.
English Language Abstract of JP 2009-10100 published Jan. 15, 2009.
English Language Translation of JP 2009-10100 published Jan. 15, 2009.
English Language Abstract of JP 2000-260578 published Sep. 22, 2000.
English Language Translation of JP 2000-260578 published Sep. 22, 2000.
Japanese Office Action issued in JP2010-015159 on Nov. 7, 2012.
English Language Translation of Japanese Office Action issued in JP2010-015159 on Nov. 7, 2012.
European Search Report issued in EP 11152006.0 on Mar. 13, 2013.
Chinese Office Action issued in CN 201110032029.4 on Apr. 17, 2013.
English Language Translation of Chinese Office Action issued in CN 201110032029.4 on Apr. 17, 2013.
English Language Abstract of TW 200901829 published Jan. 1, 2009.
U.S. Appl. No. 12/942,055 as of Jul. 5, 2013.
U.S. Appl. No. 13/162,678 as of Jul. 5, 2013.
U.S. Appl. No. 13/169,748.
U.S. Appl. No. 12/942,055.
U.S. Appl. No. 13/106,487.
U.S. Appl. No. 13/162,678.

* cited by examiner

LED LIGHTING DEVICE AND ILLUMINATION APPARATUS

INCORPORATION BY REFERENCE

The present invention claims priority under 35 U.S.C. §119 to Japanese Patent Application Nos. 2010-015158 and 2010-015159 filed on Jan. 27, 2010 and Jan. 27, 2010, respectively. The contents of these applications are incorporated herein by reference in their entirety.

FIELD

Embodiments described herein related to an LED lighting device including a non-insulated step-down chopper, and an illumination apparatus including the LED lighting device.

BACKGROUND

A light emitting diode lighting device including a non-insulated step-down chopper is conventionally known. In the conventional light emitting diode lighting device including the non-insulated step-down chopper, a resistance element having a small resistance value is connected between an FET, which is a first switching element and a first inductor, and connected between a base and an emitter of a bipolar transistor which is a second switching element. A collector of the transistor is connected to a gate terminal of the FET. The first inductor and a freewheel diode are connected in series to each other between output terminals.

When the FET is turned on, an increased current flows from a DC source via the resistance element, the first inductor and a capacitor connected in parallel to an LED circuit as a load so that the first inductor is charged. When voltage between both ends of the resistance element then reaches bias voltage for operating the transistor, the transistor is turned on and thus the FET is turned off. Since the voltage between both the ends of the resistance element is set as a base bias voltage and the transistor is turned on and the FET is turned off when the voltage reaches a predetermined voltage, timing of turn-off can always be exactly taken regardless of the voltage value induced in a second inductor. That is, the FET can always be exactly switched on/off.

When the FET is turned off, electromagnetic energy charged in the first inductor is discharged via the freewheel diode to make a decreased current successively flow in the capacitor. When the decreased current becomes zero, the FET is turned on again. This operation is repeated.

When the charged voltage of the capacitor becomes not less than the forward voltage of the LED circuit, current flows in the LED circuit and an LED of the LED circuit is lit.

Since the LED lighting device including a non-insulated step-down chopper has a relatively simple circuit constitution, capable of being downsized and high circuit efficiency and a desired low voltage can easily be obtained, it is suitably mounted on a bulb type LED of which a source is a commercial AC source and which includes an LED having a low load voltage. The bulb type LED has recently gained attention as a light source realizing energy-savings and substituting for a conventional incandescent lamp.

Additionally, it is known that current feedback is constituted in a manner that output current of the non-insulated step-down chopper undergoes voltage conversion by a resistor and is input in a control terminal of a control circuit via a diode.

As an LED bulb, a bulb including a smaller cap, for example, an E17 type cap is adopted in addition to a bulb corresponding to an incandescent bulb which is commercially available as a general illumination unit and includes an E26 type cap, and the LED bulb is required to be further downsized.

In such an LED lighting device using the non-insulated step-down chopper, it is effective to further downsize the non-insulated step-down chopper in order to respond to a request for further downsizing of the bulb type LED. As a unit for realizing the downsizing, applying integration technology mainly relating to a semiconductor device is considered.

On the other hand, since various voltage values are adopted for commercial AC sources in various countries, a bulb type LED compatible with the voltage value used in each country can be manufactured at a relatively low price so long as the LED lighting device can be constituted so as to be compatible with various voltage values by minimum design change.

Additionally, it is preferable for downsizing of the inductor to operate the non-insulated step-down chopper at high frequency.

A problem to be solved by the present invention is to provide an LED lighting device which is further downsized by integrating the non-insulated step-down chopper, easily compatible with various values of source voltage and excellent in control responsiveness in high frequency operation, and an illumination apparatus including the LED lighting device.

DETAILED DESCRIPTION

Figure 1:
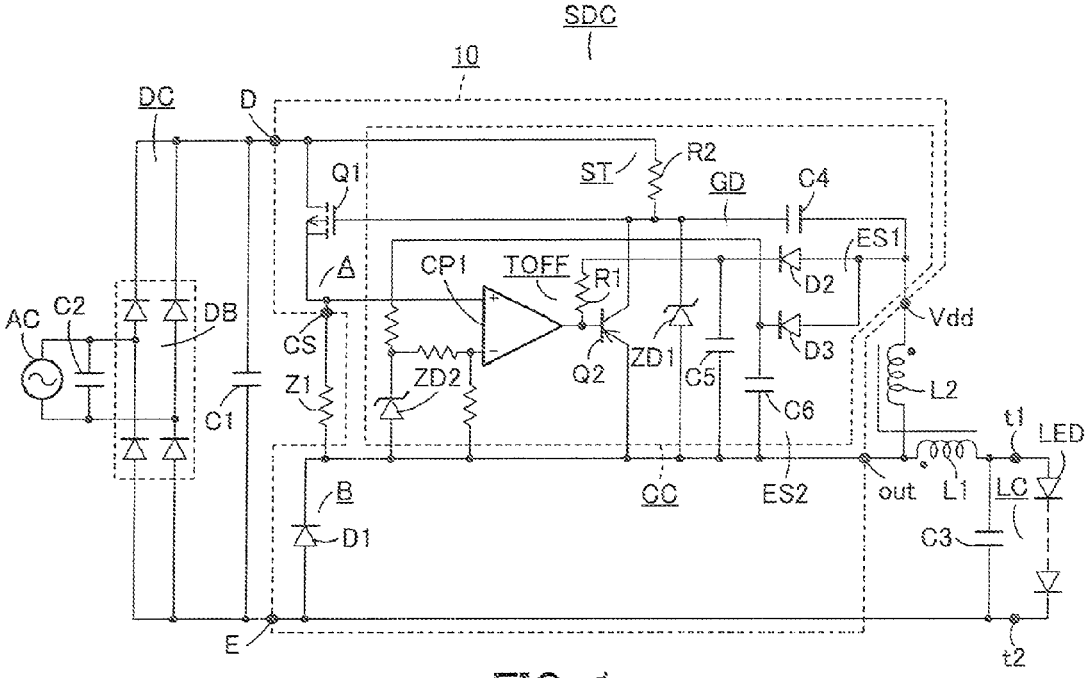
FIG. 1 is a circuit diagram of an LED lighting device of a first embodiment.

Each LED lighting device of the embodiments includes a DC source, a non-insulated step-down chopper and a light emitting diode.

The non-insulated step-down chopper includes: a first circuit in which a switching element, a current detecting impedance element and an inductor are connected in series to each other and an increased current flows when the switching element is turned on; a second circuit in which the inductor and a freewheel diode are connected in series to each other and a decreased current flows when the switching element is turned off; and a control portion for controlling at least the switching element. The control portion turns off the switching element when the switching element is turned on and the increased current flowing in the current detecting impedance element reaches a first predetermined value, and turns on the switching element when the decreased current flowing in the inductor reaches a second predetermined value smaller than the first predetermined value. The power portion including at least the switching element from among the switching element and the freewheel diode and the control portion are constituted by a single package IC, and at least the current detecting impedance element and the inductor are attached to the outside of the IC.

The light emitting diode is connected to a position on a circuit through which an increased current and a decreased current of the non-insulated step-down chopper flow.

In the embodiments, any constitution may be used for the DC source, for example, the source include a rectifying circuit as a main component, and, if desired, may further include a smoothing circuit constituted by a smoothing capacitor, etc. In this case, the rectifying circuit is preferably constituted by a bridge type rectifying circuit and obtains direct current by making AC voltage of an AC source, for example, a commercial AC source undergo full-wave rectification. Moreover, the rectifying circuit may be integrated into the single package of the IC if desired. In this case, the smoothing capacitor is preferably attached to the outside of the IC.

The non-insulated step-down chopper is a kind of a well-known step-down chopper circuit for converting and outputting input DC voltage into DC voltage lower than the input DC voltage, and a portion from an input end to an output end of the circuit is non-insulated. Although an insulated step-down chopper includes an insulated output transformer, the non-insulated step-down chopper includes no insulated output transformer as described above. Therefore, the non-insulated step-down chopper is suitable for downsizing of the LED lighting device.

The power portion, which is a circuit portion through which power to be supplied to a load passes, of the non-insulated step-down chopper includes the switching element, the current detecting impedance element, the inductor and the freewheel diode. The power portion can be divided into the first circuit and the second circuit in terms of circuit operation. The first circuit is a circuit for charging the inductor, that is, accumulating electromagnetic energy into the inductor from the DC source. The first circuit has a constitution that a series circuit including the switching element, the current detecting impedance element, the inductor and a load circuit is connected to the DC source, and, when the switching element is turned on, an increased current flows from the DC source and electromagnetic energy is accumulated in the inductor. On the other hand, the second circuit is a circuit for discharging electromagnetic energy accumulated in the inductor. The second circuit has a constitution that a series circuit of the freewheel diode and the load circuit is connected to the inductor, and a decreased current flows from the inductor when the switching element is turned off.

In the load circuit, the light emitting diode is a load, and an output capacitor to be connected in parallel to the light emitting diode can be included if desired. The output capacitor is made as a bypass so that a high-frequency wave generated mainly due to switching is prevented from being transmitted to the light emitting diode which is the load.

A secondary winding which is magnetically coupled is arranged in the inductor. When an increased current or a decreased current flows in the inductor, voltage is induced in the secondary winding. Moreover, the number of secondary windings is allowed to be single or plural. The number of the secondary windings can be arbitrarily selected in accordance with the structure of the control portion. In the embodiments, the secondary winding supplies control power to the control portion and forms an on-signal to the switching element.

The control portion is a unit for controlling operation of the non-insulated step-down chopper by controlling the switching element to be turned on/off. Although a concrete circuit constitution is not particularly limited in the embodiments, control power is supplied from the secondary winding of the inductor to the control portion. In order to control the switching element to be turned on/off, the switching element is turned off when an increased current flowing in the current detecting impedance element reaches the first predetermined value.

In order to turn off the switching element when the increased current reaches the first predetermined value, for example, a control terminal of the switching element is shorted by a switching element such as a bipolar transistor which responds to a terminal voltage of the current detecting impedance element. Additionally, when a comparator is interposed between the current detecting impedance element and the switching element in order to make the switching element respond as described above, the switching element can be reliably turned off even if the terminal voltage of the current detecting impedance element is extremely low. Consequently, power loss of the current detecting impedance element decreases, circuit efficiency rises, and temperature characteristics receive no influence from the switching element and become excellent. The switching element and the comparator can be operated by control power supplied from the secondary winding of the inductor.

On the other hand, the following control is performed for turning on the switching element. That is, when decreased current flowing from the inductor becomes zero, voltage is induced in the secondary winding due to counter-electromotive force and an on-signal of the switching element is formed based on the voltage and supplied to the switching element so as to turn on the switching element. The on-signal can be formed by directly or indirectly using the voltage induced in the secondary winding.

Additionally, at least the switching element and the control portion from among the switching element and circuit components constituting the power portion of the current detecting impedance element and the freewheel diode, are constituted by a single package IC.

The current detecting impedance element is attached to the outside of the IC for the reason that the element is a component subject to design change so as to be compatible with various values of source voltage. Additionally, since load power passes through the inductor similar to passing through each circuit component of the power portion, the inductor is a so-called power component and attached to the outside of the IC for the reason that the inductor is a component subject to design change so as to be compatible with various values of the source voltage. Additionally, as another reason, the inductor is upsized compared with a semiconductor component and is difficult to make into an IC. Moreover, the freewheel diode may be attached to the outside of the IC. In this case, a freewheel diode having an optimum specification can be designed in accordance with source voltage and load power.

Additionally, when the switching element and the freewheel diode, which complement each other in operation, of the power portion are made into an IC, these semiconductor devices can be thermally coupled to each other via a heat-radiating unit which is constituted so as to be commonly used by them. Thus, the amount of heat generated in the IC is kept fixed regardless of fluctuations in the source voltage, and the IC can be downsized by common use of the heat-radiating unit.

The light emitting diode and the switching element can be thermally coupled to each other if desired. That is, the circuit can be set to an open mode in a manner of, when heat is abnormally generated due to a breakdown mode of the light emitting diode, excessively raising the temperature of the switching element thermally coupled to the diode and breaking the switching element. Thus, the switching element for switching an LED lighting circuit can protect the light emitting diode from an abnormal state.

If the thermal coupling is performed through the heat-radiating unit of the light emitting diode, the distance between the light emitting diode and the switching element can be freely set to some extent, and consequently, the degree of freedom in terms of design of the LED lighting device as an LED light source can be raised.

Additionally, since the IC includes the control portion for controlling the switching element, a conductor connecting the switching element and the control portion is made extremely short, and consequently, the resistance and stray capacitance of the conductor connecting therebetween remarkably decrease. This is effective for signal delay reduction caused by resistance or reactance of a conductor pattern.

Regarding the IC, the power portion and the control portion may be constituted by different semiconductor chips respectively. That is, the semiconductor chip of the power portion can be used at relatively high voltage and the other semiconductor of the control portion can be used at relatively low voltage. Moreover, when a power portion includes a switching element and a freewheel diode, the power portion and the control portion may be integrated into a common semiconductor chip or may be constituted by different semiconductor chips.

Moreover, the current detecting impedance element may be inserted in series to a position on the circuit through which an increased current and a decreased current of the non-insulated step-down chopper flow in a non-smoothed state. In this case, when the control portion detects the increased current and the increased current reaches the first predetermined value, the switching element is turned off. Additionally, when the control portion detects the decreased current and the decreased current reaches the second predetermined value smaller than the first predetermined value, the switching element is turned on. In this case, the control portion operates by receiving control power generated in the IC based on DC voltage obtained from the DC source side. The DC voltage is higher than the control voltage of the control portion, a control power generating portion such as a dropper is disposed in the IC, and control power is obtained and supplied to the control portion. In order to obtain DC voltage from the DC source side, the voltage may be obtained from a terminal of the switching element in the IC, or, if desired, a connection pin connected to the control power generating portion may be led out from the IC so as to be connected to the DC source.

Additionally, the light emitting diode is connected to a position on the circuit through which an increased current and a decreased current of the non-insulated step-down chopper flow, energized by output current, which is controlled to a constant current, of the non-insulated step-down chopper and lit. A series circuit in which a plurality of light emitting diodes are connected in series to each other may be used, or a light emitting diode may be singly used. Additionally, the plurality of light emitting diodes may be connected in parallel to each other via a uniformizing shunt circuit so as to constitute a load circuit.

Since light emitting characteristics and a package form of the light emitting diode are not particularly limited, the light emitting diode can be used by properly selecting one each from known light emitting characteristics, package forms, ratings and the like. However, a white light emitting type light emitting diode is generally used as a general illumination element.

Figure 2:
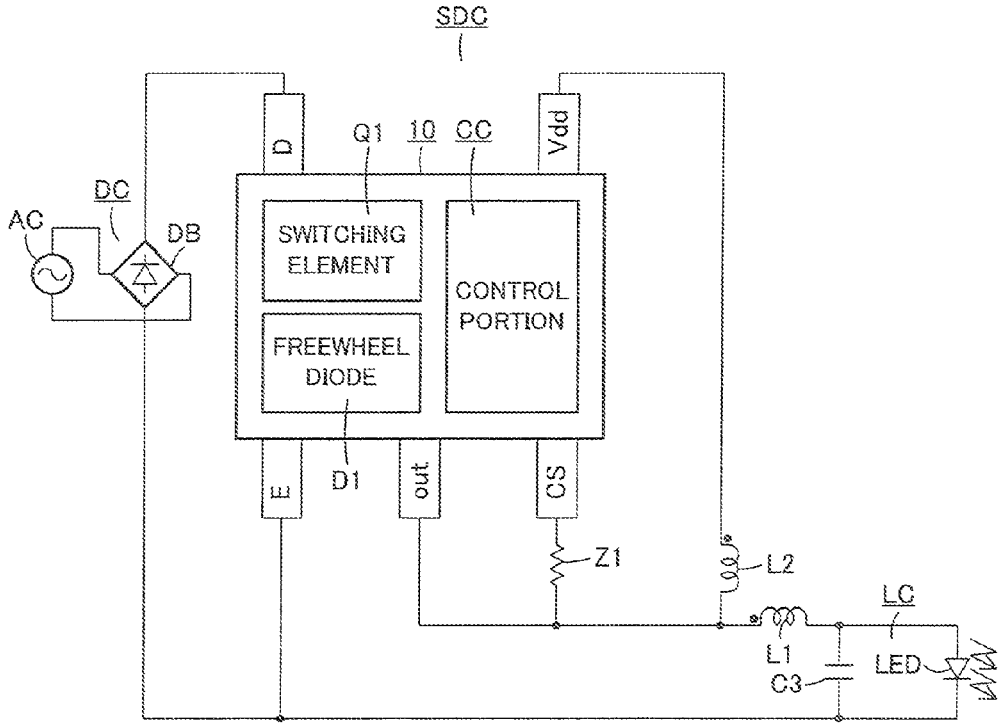
FIG. 2 is a schematic circuit arrangement diagram mainly illustrating an IC of the LED lighting device of the first embodiment.
Figure 3:
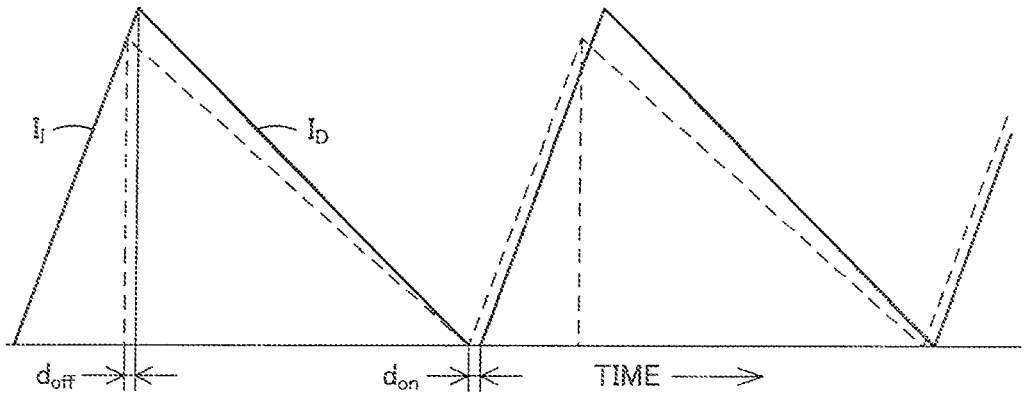
FIG. 3 is a schematic current waveform diagram for explaining influence of delay of control in a non-insulated step-down chopper.

Next, a first embodiment will be described with reference to FIGS. 1 to 3.

In FIG. 1, the LED lighting device includes a DC source DC, a non-insulated step-down chopper SDC and an LED (light emitting diode).

The DC source DC includes: a full-wave rectifying circuit DB of which the input ends are connected to an AC source AC such as a commercial AC source having a rated voltage of, for example, 100V; and a smoothing capacitor C1. The smoothing capacitor C1 is connected between output ends of the full-wave rectifying circuit DB, and can form DC output of the full-wave rectifying circuit DB into a smoothed voltage containing a proper ripple. Additionally, a noise preventing capacitor C2 is connected between the input ends of the full-wave rectifying circuit DB.

The non-insulated step-down chopper SDC includes a first circuit A, a second circuit B and a control portion CC. The first circuit A includes a switching element Q1, a current detecting impedance element Z1 and an inductor L1 in series, and is connected to the DC source DC and the LED as a load so that an increased current flows when the switching element Q1 is turned on. The second circuit B includes the inductor L1 and a freewheel diode D1 in series, and a decreased current flows when the switching element Q1 is turned off. The control portion CC controls the switching element Q1, receives control power from a secondary winding L2 magnetically coupled to the inductor L1 and makes the non-insulated step-down chopper. SDC self-excitedly drive.

Additionally, terminals D and E of the non-insulated step-down chopper SDC are connected to the output ends of the DC source DC, a terminal Vdd is connected to one end of the control portion CC side of the secondary winding L2, a terminal out is connected to one end of the freewheel diode D1 side of the inductor L1, and a terminal CS is connected to one end of the switching element Q1 side of the current detecting impedance element Z1. The other end of the secondary winding L2 connected to the inductor L1 and the other end of the freewheel diode D1 side of the current detecting impedance element Z1 are connected to each other as shown in FIG. 1. The other end of the inductor L1 and the terminal E are connected to output terminals t1 and t2. An output capacitor C3 is connected to the output terminals t1 and t2.

The non-insulated step-down chopper SDC is constituted by an IC 10 including a portion, which is surrounded by the terminals D, Vdd, CS, out and E and shown by the dotted line in the figure in a single package.

In the embodiment, the switching element Q1 of the non-insulated step-down chopper SDC is constituted by a FET (Field-Effect Transistor), and a pair of main terminals (drain and source) of the FET is connected in series to the first circuit A. The first circuit A forms a charging circuit of the inductor L1 via the output capacitor C3 and/or a load circuit LC. In the second circuit B, the inductor L1 and the freewheel diode D1 form a discharging circuit of the inductor L1 via the output capacitor C3. Moreover, the current detecting impedance element Z1 is constituted by a resistor in the embodiment, but an inductor or capacitor having a proper resistance component can be used if desired.

A desired number of LEDs are connected in series to each other and in parallel to the output capacitor C3 to form the load circuit LC, connected between the output terminals t1 and t2 of the non-insulated step-down chopper SDC, and thus lit by output current of the non-insulated step-down chopper SDC.

The control portion CC is a unit for controlling on/off of the switching element Q1, operates the non-insulated step-down chopper SDC at an operation frequency of 20 kHz or higher and a step-down rate of 0.043 or larger, and controls the switching element Q1 so that the reaction time of control of the element Q1 is 0.15 μs±20%. Thereupon, particularly, devices excellent in rising and falling characteristics are selected for the switching element Q1, a comparator CP1 and a switching element Q2 so that a satisfactory reaction time is obtained.

The control portion CC includes a driving circuit GD and a turn-off circuit TOFF of the switching element Q1, receives control power from the secondary winding L2 magnetically coupled to the inductor L1 and forms on and off signals of the switching element Q1 based on voltage induced in the secondary winding L2.

The driving circuit GD applies voltage, which is induced in the secondary winding L2, as a driving signal, between the control terminal (gate) and one main terminal (drain) of the switching element Q1 and keeps the switching element Q1 in an on-state while an increased current flows. Moreover, the other end of the secondary winding L2 is connected to the other main terminal (source) of the switching element Q1 via the current detecting impedance element Z1. Additionally, in addition to the above constitution, a capacitor C4 is interposed in series between the one end of the secondary winding L2 and the control terminal (gate) of the switching element Q1. Further, a Zener diode ZD1 is connected between output terminals of the control portion CC, and forms an anti-overvoltage circuit for preventing overvoltage, which is applied between the control terminal (gate) and one main terminal (drain) of the switching element Q1, from breaking the switching element Q1.

The turn-off circuit TOFF includes the comparator CP1, the switching element Q2 and first and second control circuit sources ES1 and ES2. A reference voltage circuit is connected to an inverting input terminal of the comparator CP1. Moreover, the reference voltage circuit includes a Zener diode ZD2, and receives power from the second control circuit source ES2 to generate reference voltage. A connection point between the switching element Q1 and the current detecting impedance terminal Z1 is connected to a non-inverting input terminal of the comparator CP1, and an input voltage is applied to the comparator CP1. An output terminal of the comparator CP1 is connected to a base of the switching element Q2 and applies output voltage to turn on the switching element Q2. Moreover, the base of the switching element Q2 is connected to the first control circuit source ES1 via a resistor R1, and control power is supplied to the comparator CP1.

The switching element Q2 is constituted by a bipolar transistor, a corrector of the element Q2 is connected to the control terminal of the switching element Q1, an emitter of the element Q2 is connected to a connection point between the current detecting impedance element Z1 and the inductor L1. Accordingly, an output end of the driving circuit GD is shorted by turning on the switching element Q2. Consequently, the switching element Q1 is turned off.

The first control circuit source ES1 is constituted by connecting a series circuit of a diode D2 and a capacitor C5 to both ends of the secondary winding L2, and the capacitor C5 is charged by an induced voltage, which is generated in the secondary winding L2 when the inductor L1 is charged, via the diode D2.

The second control circuit source ES2 is constituted in the similar manner with the above by connecting a series circuit of a diode D3 and a capacitor C6 to both ends of the secondary winding L2.

A start-up circuit ST includes a resistor R2 connected between the drain and gate of the switching element Q1 and is constituted by the capacitor C3, the secondary winding L2, the inductor L1 and the output capacitor C3. When the DC source DC is charged on, a positive start-up voltage mainly determined by the resistor R2 is applied to the gate of the switching element Q1 to start up the non-insulated step-down chopper SDC.

Next, circuit operation will be described.

In the DC source DC, the capacitance of the smoothing capacitor C1 is set to, for example, a relatively small value, a fifth harmonic rate, which is 60% or smaller, of an input current waveform. Consequently, the harmonic of the input current waveform satisfies the harmonic standard (JIS C61000-3-2 Class C) when a load is not larger than 25W in Japan.

When the DC source DC is charged on and the non-insulated step-down chopper SDC is started up by the start-up circuit ST, the switching element Q1 is turned on and an increased current linearly increasing flows from the DC source DC into the first circuit A via the output capacitor C3 or/and the LED of the load circuit LC. By the increased current, positive voltage is induced in the capacitor C4 side of the secondary winding L2 and applied, as positive voltage, to the control terminal (gate) of the switching element Q1 via the capacitor C4. Thus, the switching element Q1 is kept in the on-state, and the increased current successively flows in the switching element Q1. At the same time, the increased current causes voltage drop to the current detecting impedance element Z1, and the dropped voltage is applied, as input voltage, to the non-inverting input terminal of the comparator CP1 of the turn-off circuit TOFF.

When input voltage of the comparator CP1 increases in accordance with an increase in the increased current and exceeds the reference voltage set as the first predetermined value, the comparator CP1 operates and a positive output voltage is generated in the output terminal of the comparator. Consequently, the switching element Q2 of the turn-off circuit TOFF is turned on, the output end of the driving circuit GD is shorted, the switching element Q1 of the non-insulated step-down chopper SDC is turned off and the increased current is shut off. Here, since the reaction time of the control by the control portion CC satisfies 0.15 μs ±20%, a problem does not occur that operation of the non-insulated step-down chopper SDC undesirably changes the step-down rate to an undesired large rate.

When the switching element Q1 is turned off, electromagnetic energy is discharged, which is charged in the inductor L1 in a manner that the increased current flows during the on-state of the element Q1, and the decreased current flows in the second circuit B including the inductor L1 and the free-wheel diode D1 via the output capacitor C3 and/or the LED of the load circuit LC. Here, since the potential of the control terminal (gate) of the switching element Q1 is negative, the switching element Q1 is kept in an off-state and the decreased current successively flows in the switching element Q1.

When the discharge of the electromagnetic energy charged in the inductor L1 ends and the decreased current becomes zero that is the second predetermined value, a positive counter-electromotive force is generated in the inductor. L1, voltage induced in the secondary winding L2 is reversed, and the capacitor C5 side turns to be positive again. When the induced voltage applies a positive voltage to the control terminal (gate) of the switching element Q1 via the capacitor C4, the switching element Q1 returns to be the on-state again and the increased current flows again. Here, since the reaction time of the control by the control portion CC satisfies 0.15 μs±20%, a problem does not occur that the operation frequency of the non-insulated step-down chopper SDC undesirably lowers.

Circuit operation similar to the above operation is then repeated, a load current flows which is obtained by combining the increased current with the decreased current and has a triangular waveform, and thus the LED of the load circuit LC is lit.

Next, the IC 10 will be described with reference to FIG. 2. The IC 10 is an IC which includes the power portion of the switching element Q1 and freewheel diode D1 and the control portion CC of the non-insulated step-down chopper SDC in a single package. The circuit components are connected to each other in the IC 10 as shown in FIG. 1, and the terminals D, E, out, CS and Vdd are led outward.

Although the switching element Q1 and the freewheel diode D1 are mounted on a high-voltage chip, the control portion CC is mounted on a low-voltage chip. Moreover, the switching element Q1 and the freewheel diode D1 may be mounted on a single high-voltage chip or mounted on different high-voltage chips.

The non-insulted step-down chopper SDC is constituted by connecting the DC source DC, the current detecting impedance element Z1, the inductor L1 and the output capacitor C3 to the terminals D, E, out, CS and Vdd of the IC 10 as shown in the figure.

According to the first embodiment, the non-insulated step-down chopper SDC is provided in which the power portion including the switching element Q1 and the freewheel diode D1 and the control portion CC are constituted by a single package IC 10, and the current detecting impedance element Z1 and the inductor L1 are attached to the outside of the IC 10, thereby the non-insulated step-down chopper SDC can be further downsized, and the current detecting impedance element Z1 and the inductor L1 can be made easily compatible with various values of source voltage.

On the other hand, various values of voltage are adopted in various countries for commercial AC sources, and voltages of 100V and 200V are adopted in Japan. However, for a load used for an LED bulb, the total value of forward voltage drop (Vf) is approximately 12V, for example. Accordingly, when DC-DC voltage conversion is performed between two kinds of voltage by use of the non-insulated step-down chopper, the step-down rate (output voltage divided by input voltage) is required to be set to an extremely small rate.

On the other hand, since the inductor is used in the non-insulated step-down chopper, it is preferable for downsizing of the lighting device to raise the operation frequency and downsize the inductor.

However, in satisfying the above conditions, delay of control is caused, the step-down rate and the operation frequency are limited, and there exists a difficulty in setting desired operation conditions. Hereinafter, influence of the delay of control on the step-down rate and the operation frequency will be described with reference to FIG. 3. When an increased current $I_I$ reaches the first determined value and falling of the current is delayed by shut-off due to delay $d_{off}$ of control as shown by the solid line in FIG. 3, an on-time of the switching element is lengthened compared with the case shown by the dotted line indicating no delay, and the step-down rate becomes large. Additionally, since rising of increased current with turning-on of the switching element is delayed due to delay $d_{on}$ of control and no current flows during the delay $d_{on}$ when decreased current $I_D$ reaches the second predetermined value 0 A, the operation frequency of the non-insulated step-down chopper correspondingly lowers.

Thereupon, in the embodiment, the non-insulated step-down chopper SDC is operated at an operation frequency of 20 kHz or higher, preferably, 80 kHz or lower, a step-down rate of 0.043 or larger, preferably, 0.85 or smaller and an on-time of the switching element Q1 of 0.45 μs or longer, preferably, 1.1 μs or shorter, and the switching element Q1 is controlled so that the reaction time of control thereof satisfies 0.15 μs±20%.

Moreover, the step-down rate is a rate of output voltage to input voltage of the non-insulted step-down chopper SDC. The reaction time of control indicates: difference between time when a feedback signal is generated when a decreased current flowing in the switching element Q1 reaches the second predetermined value and time when an increased current of the switching element Q1 rises; and difference between time when a feedback signal is generated when an increased current reaches the first determined value and time when the increased current starts falling when being shut off.

It was found that the step-down rate and the operation frequency receive no influence and the non-insulated step-down chopper SDC normally operates under the above operation conditions by making the reaction time of control satisfy 15 μs±20%. However, when the reaction time of control exceeds 0.18 μs, the non-insulated step-down chopper SDC cannot be operated at a desirable step-down rate and operation frequency.

That is, when the step-down rate lowers, an output voltage set as 12V is changed to 16V, for example. In order to compensate for such a state, it is required that a resistance dropper circuit is interposed between output terminals of the current detecting impedance element Z1 and a feedback signal is correspondingly weakened. When constant current control is performed, the step-down rate exceeds a predetermined rate, overload operation occurs and the life of the LED is shortened. Additionally, in the case where the non-insulated step-down chopper SDC is designed at a critical mode, a control mode becomes a continuation mode or discontinuation mode. Moreover, when the control mode becomes the continuation mode, there is a possibility that switching loss of the switching element Q1 increases, circuit efficiency lowers, and the life of the circuit components such as the switching element Q1 is shortened.

On the other hand, when the reaction time of control is less than 0.12 μs, shortening of the reaction time of control involves high costs and no longer becomes practical although the non-insulated step-down chopper SDC can be operated at desired operation conditions. Moreover, it is more effective and suitable that the reaction time is 0.15 μs±10%.

In order that the reaction time of control is shortened for satisfying the above conditions, when the switching element Q1 is an FET, it is effective to select and adopt a switching element Q1 having a desired short on-delay time td (on) and off-delay time td (off). When the comparator CP1 is used for turning off the switching element Q1, it is effective to select and adopt a comparator having desired short transmission delay times $t_{pDH}$ (rising) and $t_{pHL}$ (falling). Additionally, for delay of the reaction time caused by wiring and component arrangement on a substrate, since at least the switching element Q1 and the control portion CC constitute the single package IC 10, this is effective for reducing signal delay caused by resistance and reactance of a conductor pattern. Proper combination of the above units allows the reaction time of control to satisfy 15 μs±20%. Moreover, the above delay time tends to become longer at turn-off and falling, compared with turn-on and rising.

As a circuit unit for turning off the switching element Q1 when an increased current reaches the first predetermined value, for example, the control terminal of the switching element Q1 is shorted by the switching element Q2 such as a bipolar transistor which responds to terminal voltage of the current detecting impedance element Z1. Additionally, when the comparator CP1 is interposed between the current detecting impedance element Z1 and the switching element Q2 in order to make the switching element Q2 respond as described above, the switching element Q1 can be reliably turned off even if the terminal voltage of the current detecting impedance element Z1 is extremely low. Consequently, power loss of the current detecting impedance element Z1 decreases remarkably, the circuit efficiency rises, and temperature characteristics receive no influence from the switching element Q2 and become excellent. The switching element Q2 and the comparator CP1 can be operated by control power supplied from the secondary winding of the inductor L1.

The non-insulated step-down chopper SDC is thus operated by the control portion CC under the operation conditions of an operation frequency of 20 kHz or higher, a step-down rate of 0.043 or larger and an on-time of the switching element of 0.45 μs or longer and at a reaction time of control of the switching element Q1 of 0.15 μs±20%, and thus limitations of the step-down rate and the operation frequency are eliminated in the above ranges and the non-insulated step-down chopper SDC can be excellently operated. Thus, there can be provided an LED lighting device suitable for an LED, which lights being connected to a commercial AC source and has a relatively small power, such as an LED bulb.

Figure 4:
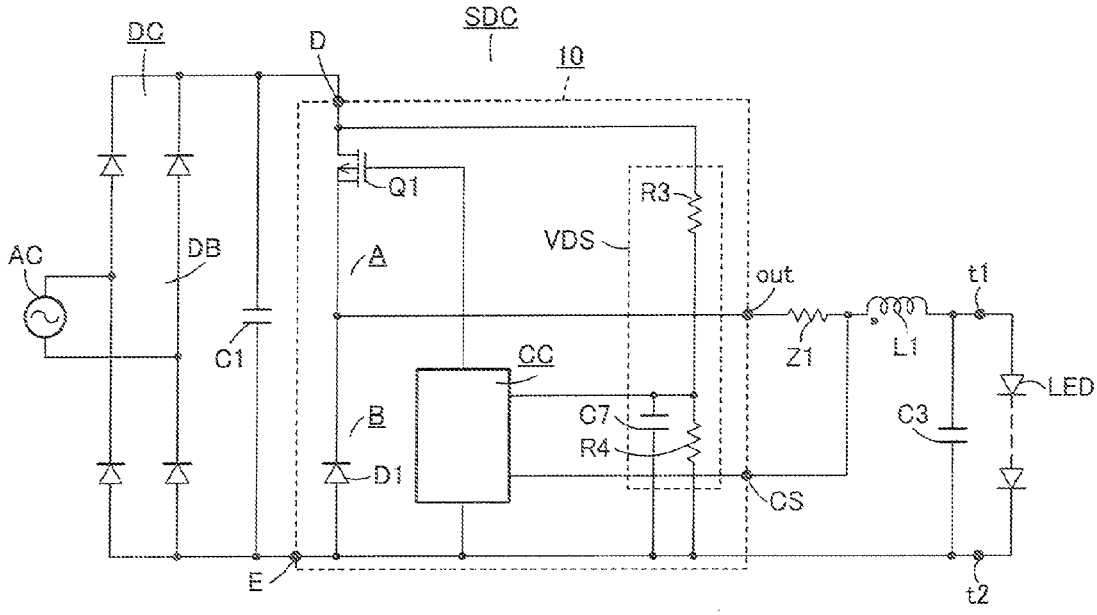
FIG. 4 is a circuit diagram of an LED lighting device of a second embodiment.
Figure 5:
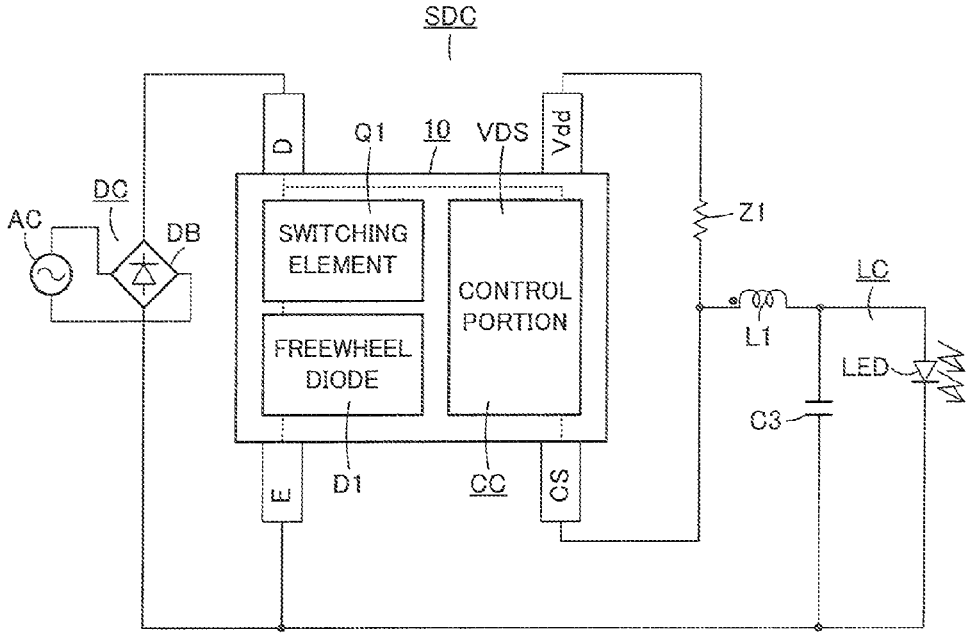
FIG. 5 is a schematic circuit arrangement diagram mainly illustrating an IC of the LED lighting device of the second embodiment.

Next, a second embodiment will be described with reference to FIGS. 4 and 5. Moreover, the same reference symbols are attached to the same structures as those of the first embodiment and description thereof will be omitted.

In the second embodiment, the current detecting impedance element Z1 is inserted in series between a connection point between the switching element Q1 and the freewheel diode D1 and the inductor L1, the insertion position corresponding to a position on the circuit through which an increased current and a decreased current of a non-insulated step-down chopper SDC flow in non-smoothed states. The control portion CC is constituted so that it performs on/off control of the switching element Q1 in accordance with voltage drop generated in the current detecting impedance element Z1.

Additionally, in the IC 10, for example, a control power generating portion VDS is disposed, as a dropper, which includes: a voltage divider constituted by a series circuit of resistors R3 and R4 connected to the DC source DC; and the capacitor C7 connected in parallel to the resistor R4, and obtains control power from both ends of the capacitor C7. Control power is supplied from the control power generating portion VDS to the control portion CC.

The control portion CC turns off the switching element Q1 when the switching element Q1 is turned on and an increased current flowing in the current detecting impedance element Z1 reaches the first predetermined value, turns on the switching element Q1 again when a decreased current flowing during the off-state of the switching element Q1 reaches the second predetermined value (for example, 0) smaller than the first predetermined value, and then repeats the on/off control of the switching element Q1 at high frequency.

In the second embodiment, since control power is generated in the IC 10, the IC 10 has four terminals.

According to the second embodiment, the non-insulated step-down chopper SDC is provided in which the power portion including the switching element Q1 and freewheel diode D1 and the control portion CC are constituted by the IC 10 in a single package and the current detecting impedance element Z1 and the inductor L1 are attached to the outside of the IC 10, thereby the non-insulated step-down chopper SDC can be further downsized, and the current detecting impedance element Z1 and the inductor L1 can be made easily compatible with various values of source voltage.

Moreover, the LED lighting device of each embodiment can be incorporated in an illumination apparatus. In this case, the illumination apparatus includes an illumination apparatus main body and the LED lighting device, and conceptually includes an LED bulb. The illumination apparatus has an LED as a light source and is generally used for illumination, but usage of the apparatus is not limited to the illumination. The illumination apparatus main body is a portion which remains after removing the LED lighting device from the illumination apparatus.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An LED lighting device comprising:

a DC source;

a non-insulated step-down chopper including:

a first circuit in which a switching element, a current detecting impedance element and an inductor are connected in series to each other through which an increased current flows when the switching element is turned on;

a second circuit in which the inductor and a freewheel diode are connected in series to each other through which a decreased current flows when the switching element is turned off;

a control portion for controlling at least the switching element, wherein the current detecting impedance element is connected between a cathode of the freewheel diode and a source of the switching element, the control portion turns off the switching element when the increased current flowing in the current detecting impedance element reaches a first predetermined value, and the control portion turns on the switching element when the decreased current flowing in the inductor reaches a second predetermined value smaller than the first predetermined value, wherein the control portion and the switching element are constituted by a single package IC, a control power of the IC is supplied from a secondary winding which is magnetically coupled to the inductor, and at least the current detecting impedance element and the inductor are attached to the outside of the IC; and a light emitting diode connected to a position on a circuit through which the increased current and the decreased current of the non-insulated step-down chopper flow.

2. The LED lighting device according to claim 1, wherein in the IC, the switching element and the control portion are constituted by different semiconductor chips, respectively.

3. The LED lighting device according to claim 1, wherein the freewheel diode is attached to the outside of the IC.

4. The LED lighting device according to claim 1, wherein the control portion operates the non-insulated step-down chopper at an operation frequency of 20 kHz or higher, a step-down rate of 0.043 or larger, an on-time of the switching element of 0.45 μs or longer and a reaction time of control of the switching element of 0.15 μs±20%.

5. An illumination apparatus comprising:

an illumination apparatus main body; and the LED lighting device according to claim 1 disposed in the illumination apparatus main body.

* * * * *